United States Patent [19]

Hewson et al.

[11] 4,091,475

[45] May 30, 1978

[54] PORTABLE TOILETS

[75] Inventors: Clifford Bruce Hewson, Toronto; John M. Stewart, Thornhill, both of Canada

[73] Assignee: Sanitation Equipment Limited, Downsview, Canada

[21] Appl. No.: 738,806

[22] Filed: Nov. 4, 1976

[51] Int. Cl.[2] ..... E03D 5/012; E03D 11/10; F16K 1/16

[52] U.S. Cl. ..... 4/321; 251/177; 251/298

[58] Field of Search ..... 4/10, 76–80, 4/86, 89, 92, 93, 115, DIG. 19; 206/509–511; 220/23.4, 23.6; 297/DIG. 2; 251/177, 228, 298, 303; 248/188.2

[56] References Cited

U.S. PATENT DOCUMENTS

| | | | |
|---|---|---|---|
| 3,190,611 | 6/1965 | Prescott et al. | 251/298 X |
| 3,801,991 | 4/1974 | Fulton et al. | 4/10 X |
| 3,842,445 | 10/1974 | Jones | 4/DIG. 19 X |
| 3,858,249 | 1/1975 | Howard | 4/78 |
| 3,949,430 | 4/1976 | Miller et al. | 4/76 |

*Primary Examiner*—Richard H. Aegerter
*Assistant Examiner*—Stuart S. Levy
*Attorney, Agent, or Firm*—Rogers, Bereskin & Parr

[57] ABSTRACT

A two piece portable toilet is described. The toilet includes a bowl unit which defines a toilet bowl having a discharge opening, and a reservoir for a flushing liquid, said reservoir having a normally closed filler opening. A holding tank is normally disposed below and supports the bowl unit. The holding tank has a top wall and defines a waste holding chamber having an inlet opening in said top wall for communication with the discharge opening of the toilet bowl. The chamber also has a normally closed outlet opening. The top wall of the tank is contoured to define a depression around the holding chamber inlet opening and, on opposite sides of the depression, surfaces for supporting said bowl unit. Coupling means normally maintain the bowl unit and holding tank in co-operating relationship when the toilet is in use. The coupling means allow the unit and tank to be separated at appropriate times. The toilet also includes pump means communicating with the reservoir in the bowl unit and with the toilet bowl and operable in use to deliver flushing liquid from the reservoir into the bowl. Valve means are also provided for controlling discharge of material from the toilet bowl into the holding chamber. The valve means are disposed in the depression in the top wall of the holding tank and includes a flap-form closure member which is pivotable about an axis generally normal to the axis of the discharge opening of the toilet bowl. The closure member is movable between a position in which the member prevents communication between the discharge opening of the bowl and the waste holding chamber, and a position in which the closure member has pivoted downwardly clear of the opening to allow discharge of material from the toilet bowl into said chamber. A valve operating means is normally disposed below and supports the closure member in its closed position and is retractable to allow the closure member to pivot downwardly about its said axis and allow communication between the discharge opening of the bowl and the inlet of the waste holding chamber.

16 Claims, 13 Drawing Figures

26
28
30
32
34
36
38
40
42
44
46
48
50
52
54
56
58
20
22
24
60
62
64
66
68
70
72
74
76
78
80
82
84
86
88
90
92
94
96
98
100
102
104
106
108
110
112
114
116
118
120
122
124
126
128
130
132
134
136
138
140
142
200
218
246
254

FIG.5
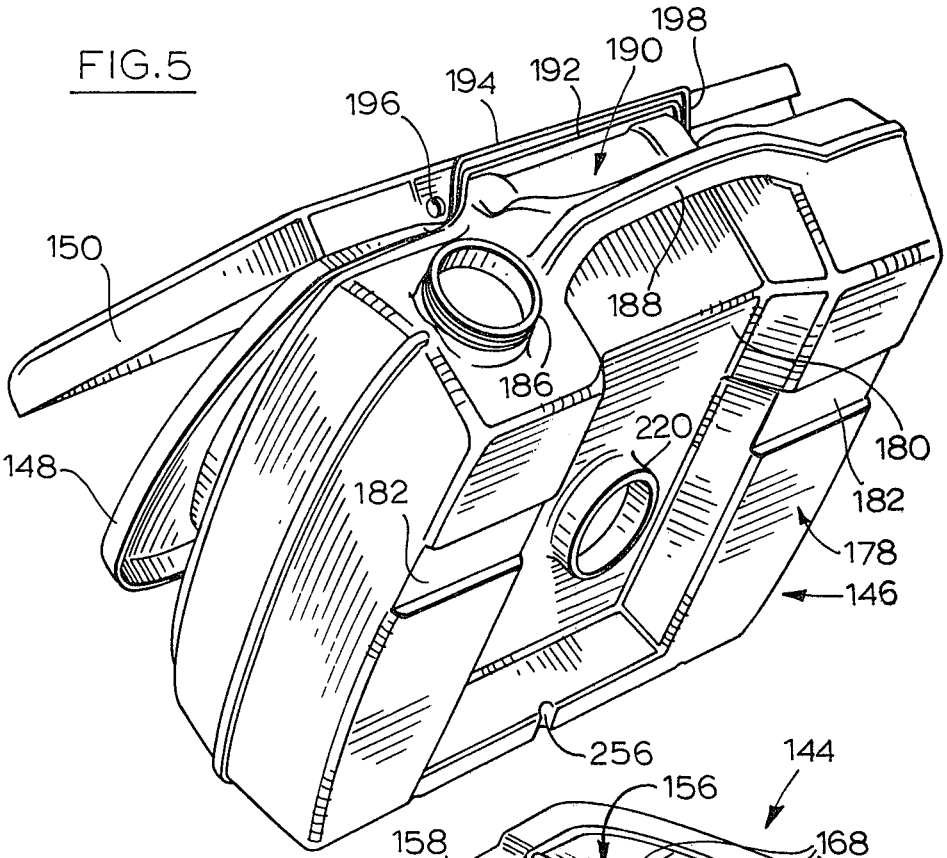
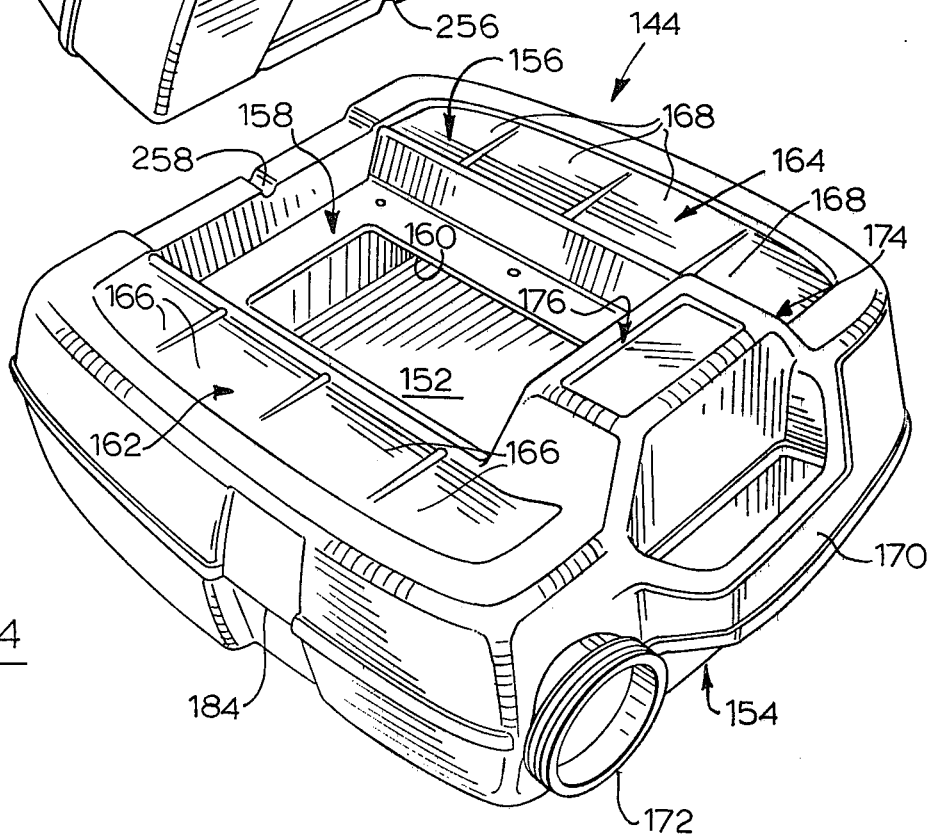
FIG.4

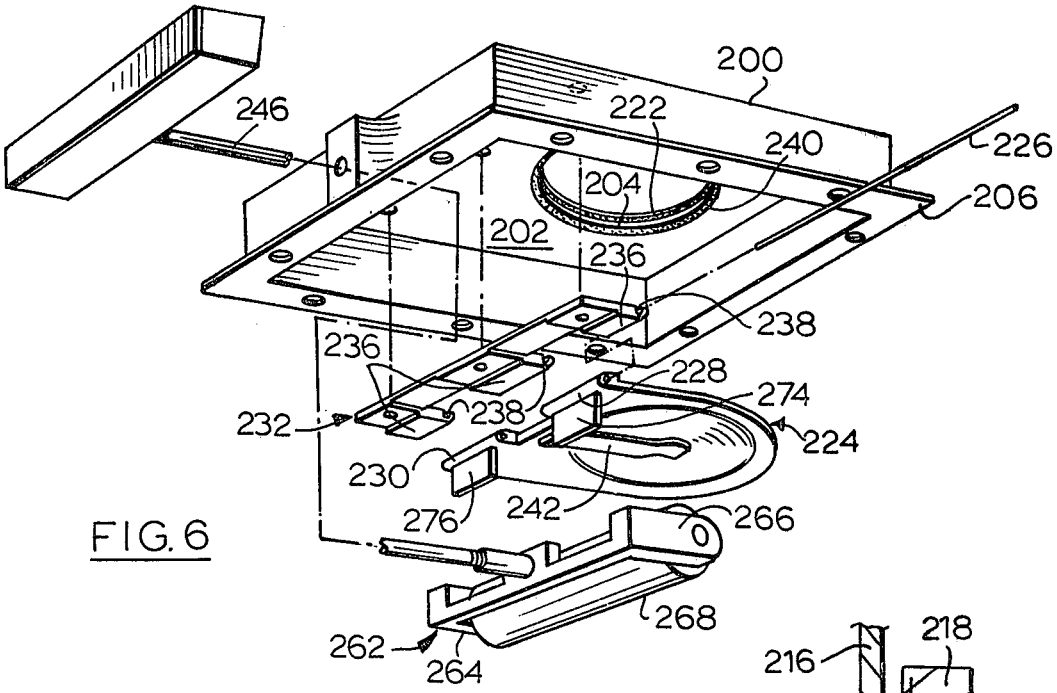
FIG. 6
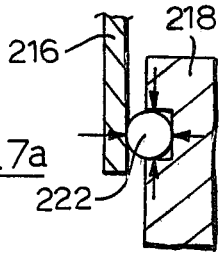
FIG. 7a
FIG. 7
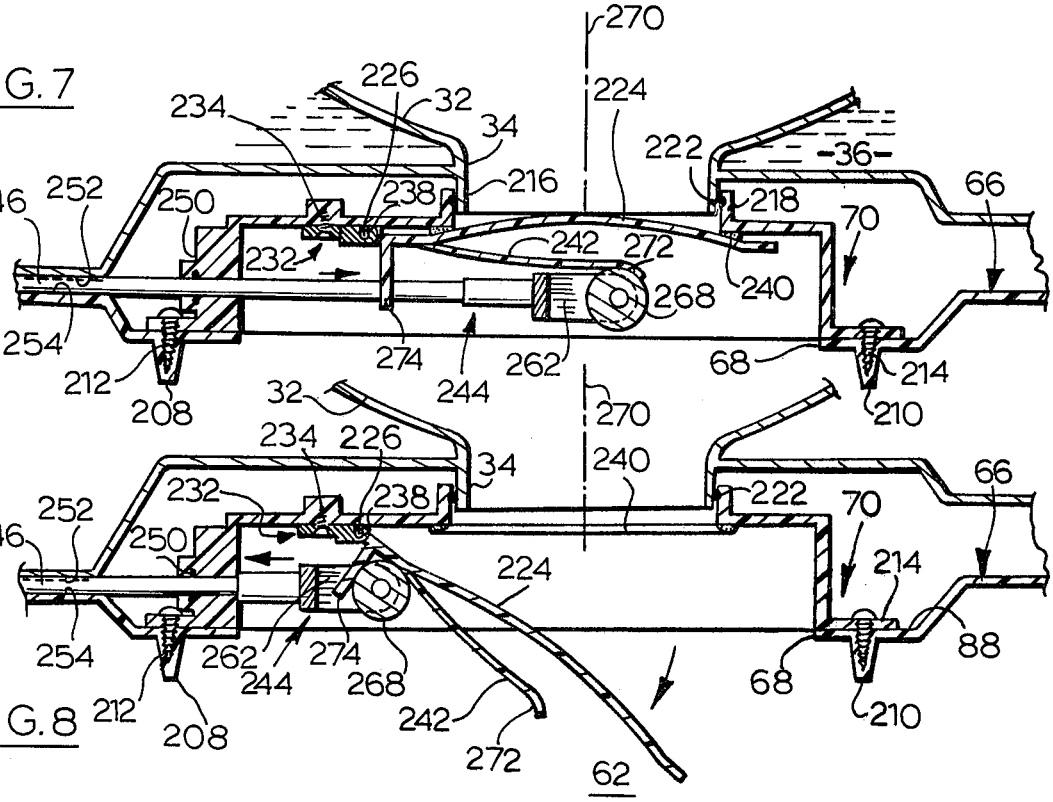
FIG. 8

PORTABLE TOILETS

This invention relates to portable toilets of the kind which include a self-contained reservoir for a flushing liquid, and a detachable waste holding tank.

A toilet of this kind is conventionally made in two parts, namely a bowl unit and a waste holding tank. The holding tank is disposed below and supports the bowl unit when the toilet is in use but can be detached when servicing the toilet. The bowl unit defines a toilet bowl and incorporates the reservoir for flushing liquid. Means are provided for delivering flushing liquid from the reservoir into the bowl when the toilet is flushed. Communication between the bowl and the interior of the holding tank is controlled by a valve which can be opened to allow material to pass by gravity from the bowl into the holding tank.

An early example of a portable toilet is disclosed in U.S. Pat. No. 484,559. More recent examples of portable toilets of the kind discussed above are disclosed in U.S. Pat. Nos. 3,570,018; 3,801,991; and 3,851,339.

Many different types of valves have been used in portable toilets. For example, the last-mentioned United States patent discloses a portable toilet having a slide valve. This type of valve is also shown in U.S. Pat. No. 3,570,018. U.S. Pat. No. 3,851,339 shows the use of a domed valve element.

Prior valve arrangements have suffered from problems due to jamming or incomplete closure of the valve member because of clogging by waste material passing from the toilet bowl into the holding tank. In the case of a slide valve, the valve member is usually received in slots which allow it to slide horizontally between an open position and a closed position. In use, these slots tend to become clogged with waste material, as a result of which, the valve member may become jammed or may be prevented from fully closing. Also, slide valves and the like have little effect in preventing air blowing back or liquid splashing from the holding chamber into the bowl when the toilet is flushed. Obviously, these difficulties with prior art toilets are undesirable since they may lead to escape of unpleasant odours and unsanitary conditions.

A structural problem with prior art portable toilets is that special arrangements have to be made to strengthen the holding tank in order that it may be able to support the weight of the heaviest person who is likely to use the toilet. If the holding tank has a flat top and hence little resistance to compressive loading, it is usually necessary to provide internal support posts between the top and bottom walls of the tank. However, these support posts reduce the capacity of the holding tank. Also, waste material tends to accumulate around the posts with the result that the holding tank may eventually become clogged.

An object of the present invention is to provide an improved portable toilet.

The toilet provided by the invention includes a bowl unit which defines a toilet bowl having a discharge opening, and a reservoir for a flushing liquid, said reservoir having a normally closed filler opening. A holding tank is normally disposed below and supports the bowl unit. The holding tank has a top wall and defines a waste holding chamber having an inlet opening in said top wall for communication with the discharge opening of the toilet bowl. The chamber also has a normally closed outlet opening. The top wall of the tank is contoured to define a depression around the holding chamber inlet opening and, on opposite sides of the depression, surfaces for supporting said bowl unit. Coupling means normally maintain the bowl unit and holding tank in co-operating relationship when the toilet is in use. The coupling means allow the unit and tank to be separated at appropriate times. The toilet also includes pump means communicating with the reservoir in the bowl unit and with the toilet bowl and operable in use to deliver flushing liquid from the reservoir into the bowl. Valve means are also provided for controlling discharge of material from the toilet bowl into the holding chamber. The valve means are disposed in the depression in the top wall of the holding tank and include a flap-form closure member which is pivotable about an axis generally normal to the axis of the discharge opening of the toilet bowl. The closure member is movable between a position in which the member prevents communication between the discharge opening of the bowl and the waste holding chamber, and a position in which the closure member has pivoted downwardly clear of the opening to allow discharge of material from the toilet bowl into said chamber. A valve operating means is normally disposed below and supports the closure member in its closed position and is retractable to allow the closure member to pivot downwardly about its said axis and allow communication between the discharge opening of the bowl and the inlet of the waste holding chamber.

In order that the invention may be more clearly understood, reference will now be made to the accompanying drawings which illustrate a number of embodiments of the invention by way of example. In the drawings:

FIG. 4 is a perspective view from one end and above of the holding tank of a toilet according to another embodiment of the invention;

FIG. 5 is a perspective view from below of the bowl unit of the toilet of FIG. 4;

FIG. 6 is an exploded perspective view from below of the valve assembly of the toilet of FIGS. 1 to 3;

FIG. 7 is a longitudinal vertical sectional view through the valve assembly of FIG. 6 with the closure member of the valve in the closed position;

Figure 9:
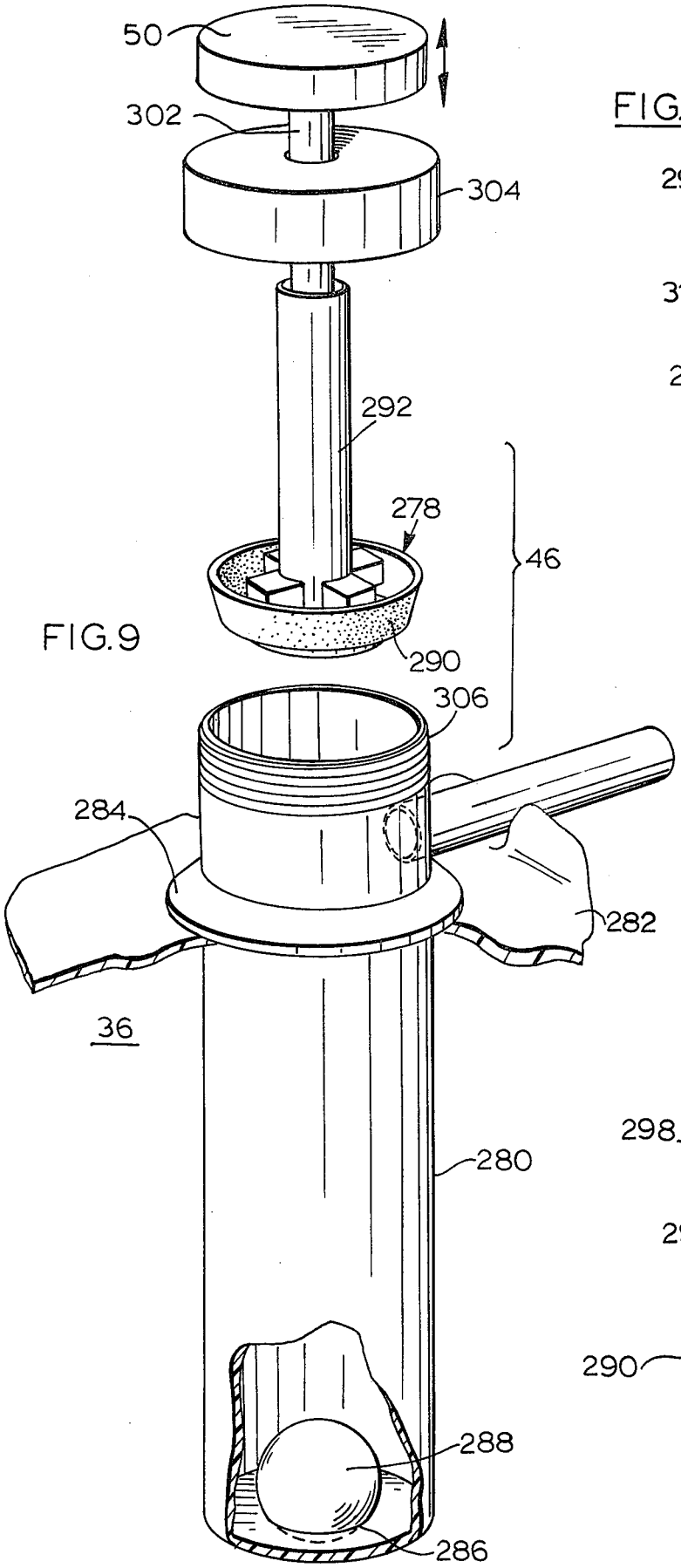
Figure 11:
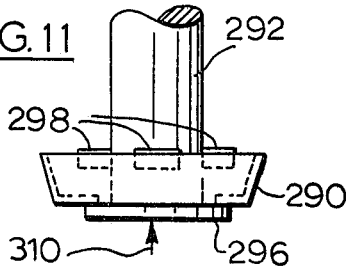
Figure 12:
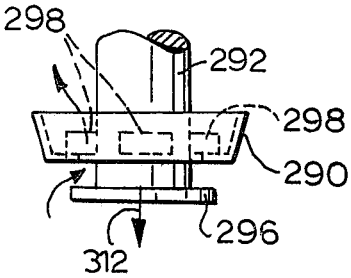
Figure 10:
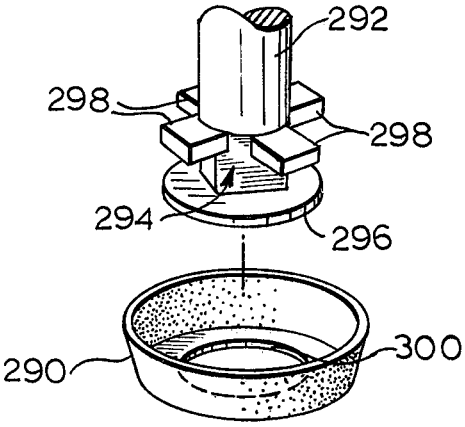

FIG. *7a* is a detailed view of part of FIG. 7;

FIG. 8 is a view similar to FIG. 7 showing the valve closure member in the open position;

FIG. 9 is a partly exploded perspective view of a pump for use in a toilet according to the first embodiment described above;

FIG. 10 is an exploded perspective view of part of FIG. 9; and,

FIGS. 11 and 12 are side views of the part of the pump shown in FIG. 10 as assembled and illustrate the operation of the pump.

Figures 1, 2, 3:
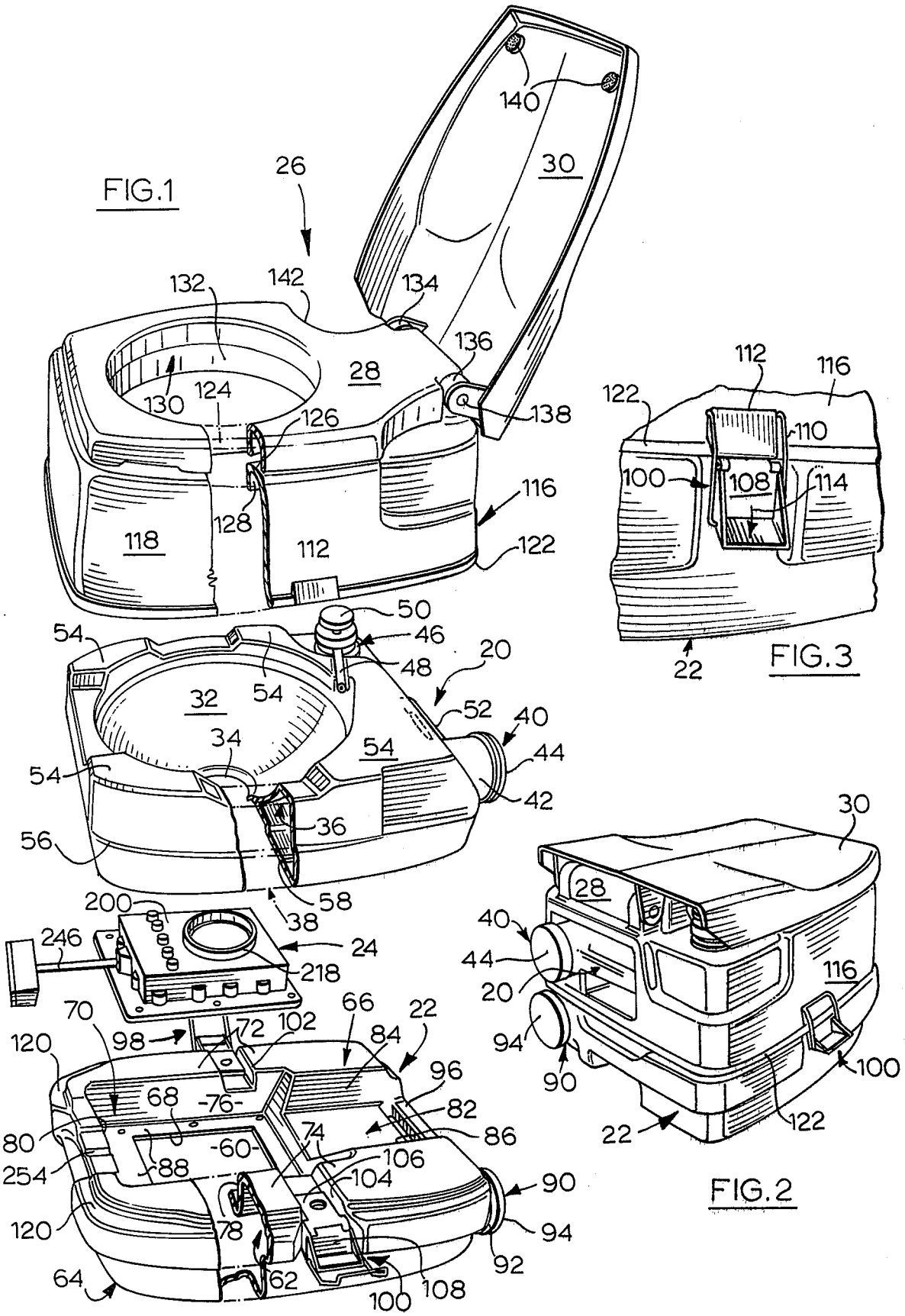
FIG. 1 is an exploded perspective view from one side of a toilet according to one embodiment of the invention.
FIG. 2 is a perspective view from the rear and the opposite side of the assembled toilet of FIG. 1.
FIG. 3 is a detail view of part of FIG. 2.

Toilets of the general kind shown in the drawings are commonly referred to as two-piece portable toilets. As indicated above, a toilet of this kind includes a waste holding tank, and a bowl unit which defines a toilet bowl and which is supported on the holding tank. FIGS. 1 to 3 illustrate a two-piece portable toilet according to one embodiment of the invention and FIGS.

4 and 5 illustrate a second embodiment in which the bowl unit and holding tank of the toilet are of somewhat different form. FIGS. 6 to 8 and 9 to 12 show respectively the valve assembly and pump of the toilet of FIGS. 1 to 3. These components may also be used in the toilet of FIGS. 4 and 5 although, for clarity of illustration, they are not shown in those views.

Reference will first be made to FIG. 1 in describing one embodiment of the invention. The toilet shown in FIG. 1 includes two principal parts: a bowl unit 20 and a holding tank 22. When the toilet is in use, the bowl unit 20 is positioned on top of and supported by the holding tank 22. A valve assembly generally indicated at 24 is interposed between the holding tank 22 and the bowl unit 20. In this particular embodiment, the toilet also includes a separate seat section generally denoted 26. Section 26 includes toilet seat 28 and a lid 30 and fits over the bowl unit 20 in the assembled toilet as will be described.

The parts of the toilet are made entirely of plastic materials as are possible. In this embodiment, the bowl unit 20 and the holding tank 22 are blow moulded in polyethylene while the seat section 26 is moulded in an ABS plastic material.

Bowl unit 20 is shaped to define an open topped toilet bowl 32 having at its lower end a discharge opening 34. Unit 20 is a hollow-walled moulding and defines a reservoir 36 which extends around the bowl 32 and which is intended to receive a flushing liquid. In FIG. 1, part of the bowl unit has been broken away as indicated by reference numeral 38, to show the shape of the walls of the reservoir 36 at the particular location chosen. The reservoir has a normally closed filler opening generally denoted 40, defined by cylindrical formation 42 which projects rearwardly of bowl unit 20. Formation 42 has external screw threads (not visible) at its outer end and is fitted with a screw closure cap 44. Although reservoir 36 can be filled with any suitable flushing liquid, water will normally be used. Thus, reservoir 36 may conveniently be filled with flushing water from a faucet or pail by turning the powl unit on end so that the filler opening 40 projects upwardly, and removing cap 44.

A pump generally denoted 46 is fitted in an opening in the top wall of the bowl unit 20. The pump will be more specifically described later in connection with FIGS. 9 to 12. For present purposes, it is sufficient to note that the pump has a discharge nozzle 48 which projects generally tangentially with respect to the bowl 32 of unit 20. The pump has an operating knob 50 which is lifted and then pressed downwardly as will be described, causing a charge of flushing water to be expelled from nozzle 48. The water will flow in a spiral path around and down the inner surface of bowl 32 to discharge opening 34.

In order that the bowl unit 20 may be carried separately from the other components of the toilet, its rear end wall is shaped to define a carrying handle 52. It will also be noted that the top wall of the bowl unit is moulded to define raised portions 54 which tend to enhance the strength of the unit and its resistance to compressive loading. A strengthening rib 56 also extends around the side wall of the unit. The bottom wall 58 of bowl unit 20 is upwardly dished to a slight extent similar to the bowl unit shown in FIG. 5 (to be described) in order to provide clearance for the valve assembly 24 of the toilet.

The waste holding tank 22 of the toilet defines a waste holding chamber indicated at 60. Part of the tank is broken away as indicated as 62 to show the shape of parts of the tank walls. The tank has a flat bottom wall 64 and a specially shaped top wall 66 having a rectangular inlet opening 68 for chamber 60. The top wall 66 of the tank is contoured to define a depression 70 around the holding chamber inlet opening 68 and, on opposite sides of depression 70, surfaces 72 and 74 for supporting the bowl unit 20. It will be seen that the support surfaces 72 and 74 are both flat and extend generally longitudinally of the holding tank so as to provide for balanced support of the bowl unit 20. The corresponding portions of the bottom surface 58 of bowl unit 20 are also flat.

It will be noted that depression 70 has generally upright side walls 76 and 78 and an upright front end wall 80. At its opposite end, depression 70 merges with a generally U-shaped depression 82 which also has generally upright side walls 84 and 86. Depression 70 is found to give the holding tank greatly enhanced resistance to the compressive loading which occurs when a person is seated on the toilet, compared to the compressive resistance of a holding tank having a more normal flat upper surface, and avoids the need for internal support posts in the holding tank as mentioned previously.

A further advantage which arises from the existence of depression 70 is that the valve assembly 24 is at least partially protected against damage when the holding tank has been detached from the remainder of the toilet. Thus, as can be seen from the drawing, a flat peripheral area 88 extends around the inlet opening 68 for the waste holding chamber. This provides an attachment surface for the valve assembly 24 which fits snugly into the depression 70 and is protected by the sides of the tank which define the support surfaces 72 and 74.

Holding tank 22 is provided with a discharge opening 90 which is similar to the filler opening 40 of the bowl unit 22. Discharge opening 90 is defined by a cylindrical formation 92 at the rear end of the holding tank and is fitted with a screw threaded cap 94 similar to cap 44 described above. Also, the holding tank has a handle 96 by which the tank can be carried after detachment from the remainder of the toilet.

At each side, the holding tank is fitted with clips 98 and 100 for coupling together the holding tank 22, bowl unit 20 and seat section 26 as will be described. The clips are fitted in channels 102, 104 in portions of the respective support surfaces 72 and 74 of the top wall 66 of the holding tank. Both clips are over-centre type wire loop clips and clip 100 will now be briefly described as representative of both clips. Clip 100 includes an attachment plate 106 which is fitted to the bottom of the channel 104 in the holding tank so as to project laterally of the tank to a slight extent. Pivotally coupled to the projecting end of plate 106 is a carrier member 108 of triangular shape in side view. A wire loop element 110 is itself pivoted to member 108. Accordingly, the wire loop element 110 can pivot with respect to member 108 and that member can itself, in turn, pivot with respect to the attachment plate 106. Clips 98 and 100 are both shown in the "off" positions in FIG. 1; and the clips 98 and 100 are shown in their "on" positions in FIGS. 2 and 3 respectively. Referring to FIG. 3 by way of example, the wire loop element 110 is shown with its upper end engaged behind a formation 112 on the side of the seat section. This is the first step in engaging the clip. At this time, the carrier member 108 adopts a position in which its lower end is outwardly inclined. The clip is locked by pushing the outer end of member 108 downwardly generally in the direction of arrow 114 in FIG. 3 so that the pivot points of the wire loop element 110 to member 108 pass "over-centre" below the pivot axis of member 108 to its attachment plate 106, whereby the clip snaps over-centre and locks in position.

Seat section 26 includes a base 116 which defines a skirt 118 shaped to fit around the bowl unit 20. Referring back to the holding tank, it will be noted that the tank is shaped to define ledges 120 at both sides. The skirt 118 of seat section 26 has a rim 122 around its lower edge which rests on the ledges 120 of the holding tank. Formed integrally with rim 122 are two clip attachment formations 112 (only one of which is visible) located in positions to correspond with the positions of the clips 98 and 100.

Part of the seat section 26 is broken away at 124 in similar fashion to the break line shown in the bowl unit and holding tank. As can be seen at break line 124, the seat section base has a top wall 126 which defines an opening 130 having a downwardly projecting inner flange 152. The bottom edge of this flange rests on the tops of the upwardly projecting formations 54 of the bowl unit. Accordingly, when the clips 98 and 100 are engaged and locked onto the formations 112, the seat section is firmly locked to the holding tank with the bowl unit 20 firmly clamped between the seat section and the tank.

Adjacent its rear edge, the base 116 of seat section 26 has a pair of upwardly projecting formations 134 and 136 having pins projecting therefrom, one of which is visible at 138. These pins pivotally support the seat 28 and the lid 30 of the seat section 26 so that the seat and the lid are individually pivotable with respect to the base 116. Pads 140 are provided inside the lid and rest in contact with the seat when the lid is closed. The lid is shown in this position in FIG. 2. It will be noted that the pump 46 is covered by the lid at this time. However, the top 132 of the base 116 and the seat 128 are cut away as indicated at 142 to expose the top of the pump 46 when the lid is open.

It will be appreciated that servicing of the toilet may be effected simply by releasing the clips 98 and 110 and lifting off the seat section 26 to expose the bowl unit resting on the holding tank. The bowl unit may then be simply lifted off the holding tank and refilled from a suitable water supply by way of inlet opening 40. If necessary, the carrying handle 52 can be utilized for transporting the bowl unit to the supply. In similar fashion, the holding tank, with valve assembly attached may be transported to a suitable site for disposal of the waste material inside chamber 60. Handle 96 may be conveniently used for carrying the tank at this time. After emptying of the tank and washing out by way of outlet 90, the toilet can readily be reassembled by reversing the procedure outlined above.

FIGS. 4 and 5 show a portable toilet according to another embodiment of the invention. A principal difference between the toilet of FIGS. 1 to 3 and the toilet of FIGS. 4 and 5 is that, in the latter embodiment, there is no separate seat section. The toilet includes a lid and seat which are directly coupled to the bowl unit.

In FIGS. 4 and 5, the holding tank is generally denoted 144 and bowl unit is denoted 146. A seat is indicated at 148 and a lid at 150. Referring first to FIG. 4, the holding tank 144 is a hollow blow moulding as in the previous embodiment and defines a waste holding chamber 152. The tank has a flat bottom wall 154 and a top wall 156 which is contoured to define a depression 158 surrounding an inlet opening 160 for chamber 152 and support surfaces 162 and 164 on opposite sides of the depression 158. Shallow rectangular depressions 166 and 168 are provided in surfaces 162 and 164 respectively for extra strength. As described above, the valve assembly is intended to be fitted onto the base of depression 158 so as to close the inlet opening for chamber 152. Also as described above, tank 144 is formed with an integral carrying handle 170 and with a discharge opening 172 for emptying the chamber 152.

In contrast to the preceding embodiment, an upwardly extending formation 174 is provided at the rear end of depression 158. Viewed from the rear end of the holding tank, formation 174 is of truncated generally triangular shape and has a flat top 176. This makes the holding tank stronger and better able to withstand the compressive loads to which it is subjected when a person is seated on the toilet. As can be seen from FIG. 5, the bowl unit 146 has a bottom wall 178 formed with a depression 180 which is of a shape corresponding generally to the shape of the formation 174. Accordingly, the portion of the bottom wall 178 which defines depression 180 rests on the flat top 176 of formation 174 whereby surface 176 forms an additional support surface of the top wall of holding tank 144. The complimentary shaping of formation 174 and depression 180 also assists in laterally locating the bowl unit against transverse displacement with respect to the holding tank. In addition, the bowl unit and holding tank are coupled together by over-centre clips similar to those described in connection with the preceding embodiment. In contrast to that embodiment, however, the clips are attached to the bowl unit and are engaged with formations on the holding tank. An attachment point for one of the clips to the bowl unit is indicated at 182 and one of the formations on the holding tank for engagement by the clip is indicated at 184. The clips themselves have not been shown since they are similar to the clips 98 and 100 of FIGS. 1 to 3.

The bowl unit shown in FIG. 5 also has a filler opening 186 and a carrying handle 188 as described in connection with the preceding embodiment. Just above the handle 188, the rear end wall of the bowl unit is provided with a formation 190 of generally triangular shape in side view to which the seat 148 and lid 150 are attached. Both of these elements are formed with generally rectangular shaped sections 192 and 194 respectively at their rear ends which fit over the formation 190. Section 192 is slightly smaller than section 194 and fits inside the latter. Headed pins 196 and 198 pass through the sections and into formation 190 to pivotally couple the seat 148 and lid 150 to the bowl unit.

It will of course be appreciated that the toilet shown in FIGS. 4 and 5 can be serviced in similar fashion to the toilet described in connection with the preceding Figures, except that there is no seat section (reference numeral 26) to remove before the toilet can be dismantled. It is simply necessary to release the retaining clips and separate the holding tank and bowl unit for servicing.

FIG. 6 to 8 illustrate the valve assembly 24 of the toilet of FIGS. 1 to 3. As pointed out above, it is however to be understood that the same valve assembly may be used in the toilet of FIGS. 4 and 5.

Valve assembly 24 includes a rectangular boxform housing 200 which is open at the bottom and is formed with a top wall 202 having a circular opening 204. An integral attachment flange 206 extends around the bottom of the housing and is intended to fit onto the support surface 88 of recess 70 in the top wall 66 of the holding tank. FIGS. 7 and 8 are cross-sectional views which show the valve assembly in position on the top wall 66 of the holding tank. The flange 206 on the valve housing 200 is formed with apertures to receive self-tapping screws which fit into integrally-moulded lugs depending from the top wall 66 of the holding tank around opening 68. Two of these lugs are visible at 208 and 210 in FIGS. 7 and 8 and receive self-tapping screws 212 and 214. FIGS. 7 and 8 also show part of the bottom wall 58 of the bowl unit 20. Part of the bowl 32 and the bowl discharge opening 34 are also visible. It will be noted that a cylindrical element 216 depends from the bottom wall 58 of the bowl unit and fits inside a similar, upwardly projecting element 218 on the top wall 202 of the valve housing 200. This cylindrical element 216 is not visible in FIG. 1 although a similar element is indicated at 220 at the underside of the bowl unit 146 of FIG. 5. The upwardly projecting cylindrical element 218 on the valve housing is formed with an internal annular groove which receives a circular-section sealing ring 222 arranged to bear against the external surface of the element 216 which depends from the bowl unit. FIG. *7a* is an enlarged detail view showing the seal 222. The elements 216 and 218 and the sealing ring 222 are dimensioned so that the ring is subject to compression on all sides as indicated by the arrows in FIG. *7a*. As a result of the fact that the ring 222 is permanently under compression, an extremely efficient seal is achieved between the bowl unit 20 and the valve assembly 24.

Disposed inside the valve housing 200 is a valve closure member 224, the shape of which can best be seen in FIG. 6. Closure member 224 is essentially in the form of a flap and is pivotally mounted on the underside of the top wall 202 of the valve housing for pivotal movement about an axis generally normal to the axis of the discharge opening 34 of the bowl unit. The pivot axis for the valve closure member 224 is formed by a thin wire rod 226 (FIG. 6) which passes through aligned openings in two formations 228 and 230 at one end of the closure member and which is also received in an attachment member 232. Member 232 is secured by self-tapping screws, one of which is indicated at 234 in FIGS. 7 and 8, to the underside of the top wall 202 of valve housing 200. Member 232 has three forwardly projecting lugs 236 which co-operate with the formations 228 and 230 on the valve closure member to retain the pivot rod 226. The lugs 236 are formed with open-topped slots 238 through which rod 226 passes and which allow the rod a certain amount of free movement towards and away from the top wall 202 of the valve housing. Accordingly, the closure member 224 can float within limits; this makes for improved sealing efficiency as will be described.

As can best be seen in FIGS. 7 and 8, the valve closure member 224 is of upwardly-curved configuration and is shaped to fit inside the circular opening 204 in the top wall 202 of the valve housing 200. A valve seat is formed around opening 204 by a strip 240 of neoprene foam which is struck to the inside surface of the top wall 202 and which has on its outer surface a "skin" against which the closure member 224 seals. In other words, the closure member does not seal directly against the underside of the bowl unit but against part of the valve housing 200, which housing is in turn sealed to the bowl unit by the ring seal 222. The fact that the valve closure member 224 can float as described above allows the closure member to move to take up any irregularities in the valve seat due, for example, to the presence of waste material which has lodged on the valve seat or closure member in passing from the bowl to the holding tank.

The valve closure member 224 is part of a one-piece plastic moulding which also includes an integral spring member 242 which is of elongate strip form and which is disposed below the closure member 224. This member is visible in perspective view in FIG. 6 and in side view in FIGS. 7 and 8. It co-operates with a valve operating assembly generally denoted 244 which is movable between an advanced position in which it is shown in FIG. 7 and in which it supports the closure member 244 in the closed position, and a retracted position in which it is shown in FIG. 8 in which the closure member has pivoted downwardly clear of the valve seat, bringing the toilet bowl 32 into communication with the holding chamber 60 inside the holding tank 22. The operating assembly includes an axially slidable rod 246 which passes through an opening 248 in the relevant end wall of the valve housing 200. A ring seal 250 (FIGS. 7 and 8) extends around the rod 248 inside the housing 200. Rod 248 extends outwardly from housing 200 and is slidably received in grooves 252, 254 disposed respectively in the lower face of the bowl unit 20 and in the upper face of the top wall 66 of the holding tank 22. Groove 254 is in fact visible in FIG. 1 and similar grooves 256 and 258 can be seen in FIGS. 4 and 5. Accordingly, rod 246 projects from the front of the toilet where it is fitted with a transverse handle 260. The rod is guided by the grooves 252 and 254 and by the opening 248 in housing 200 so as to slide horizontally in a direction transverse to the pivotal axis of the valve closure member 224. At its inner end, rod 246 is coupled to a U-shaped member 262 having side limbs 264, 266 which turnably support a roller 268. Roller 268 cooperates with the integral spring 242 below the closure member 224. In FIG. 7, member 224 is in the fully closed position. At this time, the roller 268 of the valve operating assembly is disposed just past the centre line 270 of the bowl discharge opening 34. The arrangement is such that, at this time, spring member 242 is slightly tensioned so that the closure member 224 is gently spring biased against the valve seat defined by the neoprene strip 240. Spring member 242 is curved slightly at its outer end as indicated at 272 so as to define a seat into which roller 268 fits to lock the closure member 224 in the closed position.

The moulding which defines the valve closure member 224 also defines two elements 274, 276 which depend from the formations 228, 230 respectively in which the pivot rod is received. These elements cooperate with the roller 268 of the valve operating assembly when the assembly is retracted so that the valve closure member 224 is moved positively to the open position. It will of course be appreciated that there will be at least some tendency for the valve closure member to open automatically under gravity. However, the elements 274 and 276 will eliminate any possibility of the closure member sticking.

Reference will now be made to FIGS. 9 to 12 of the drawings in describing the pump 46 used to deliver flushing liquid into the bowl of the toilet. As indicated above, although the following description relates specifically to the pump 46 shown in the embodiment of FIGS. 1 to 3, this pump may also be used in the embodiment of FIGS. 4 and 5.

Pump 46 is a piston-type pump and includes a piston 278 slidably received in a cylinder 280. Cylinder 280 is mounted in a vertical position in an opening in the top wall of the bowl unit 20. Part of this wall is indicated at 282 in FIG. 9. The cylinder is arranged so that, while its upper end portion projects above the wall 282, the majority of the cylinder is disposed within the flushing liquid reservoir 36. In fact, the arrangement is such that the lower end of the cylinder is spaced to a slight extent only above the bottom wall of the bowl unit. A collar 248 extends around the cylinder and rests on wall 282 to define the vertical position of cylinder 280. The discharge nozzle 48 of the pump 46 is visible in FIG. 9 and is in the form of a plain tube which projects from the exposed upper portion of cylinder 280. In another embodiment, the outer end portion of tube 48 can be angled slightly to direct the flushing liquid as appropriate.

Cylinder 280 has an inlet opening 286 at its lower end which is normally closed by a ball 288. Ball 288 is made of glass and is free inside cylinder 280. When the piston 278 is lifted in cylinder 280 as will be described, the low pressure zone which results below the piston causes the ball 288 to be lifted off its seat, drawing flushing liquid into the lower portion of cylinder 280. When the piston moves downwardly, the ball returns to its seat and prevents the flushing liquid being expelled through opening 286.

Piston 278 is defined by a cup-shaped seal member 290 (shown separately in FIG. 10) loosely mounted on the lower end of a piston rod 292. As can be seen from FIG. 10, the piston rod 292 has a squared lower end portion 294 fitted at its lower end with a flange 296. Four generally square shaped elements 298 project outwardly from piston rod 292 just above the squared portion 294 and are disposed mutually at right angles with respect to one another. The cup-shaped seal member 290 has a circular opening 300 in its base and the member is fitted to the lower end of the piston rod so that the part of the base which defines the opening 300 fits around the squared portion 294 of of rod 292. Accordingly, gaps are present between the faces of the squared portion 294 of the seal member. Also, the seal member can float between the flange 296 and the elements 298 on the piston rod 292.

Piston rod 292 has an upper end portion 302 which is of reduced diameter compared with the remainder of the piston rod. A cap 304 is slidably mounted on this portion of the piston rod and is adapted to be fitted to the top of cylinder 280 by screw threads 306 on cylinder 280 and co-operating screw threads inside the cap 304. Piston rod 302 has operating knob 50 (see also FIG. 1) at its upper end.

FIGS. 11 and 12 illustrate how the piston seal member 290 floats as the piston is moved up and down in cylinder 280 by means of the operating knob 308. FIG. 11 shows the piston rod 292 moving upwardly as indicated by arrow 310. At this time, the flange 296 at the lower end of the piston rod bears against the seal member 290 so that liquid is unable to pass between the seal member and the piston rod. Accordingly, liquid above the piston will be expelled through the nozzle 48 of the pump. At the same time, the low pressure effect created below the piston will cause flushing liquid to be drawn into cylinder 280 through the opening 286 in its lower end, thereby filling the lower portion of the cylinder. When the piston now moves downwardly as indicated by the arrow 312 in FIG. 12, the seal member 290 will move up into contact with the elements 298 on the piston rod and the liquid which was below the piston will flow between the valve member 290 and the squared portion 294 of the piston rod as indicated by the arrows 314. Accordingly, the upper part of the cylinder will become charged with liquid. This liquid will be expelled the next time the piston is raised by means of the operating knob as described in connection with FIG. 11.

It will be appreciated that the portable toilet of the invention has many advantages compared with prior art portable toilets. For example, the valve mechanism of the present invention is less prone than prior art slide valve mechanisms to jamming or incomplete closure due to the presence of waste material. The fact that the valve closure member of the invention is held in the closed position under a spring bias effect and the presence of the particular seal used helps improve efficiency of sealing. Also, the roller-type valve operating mechanism of the invention in combination with the integral spring member having a curved outer end serves to positively lock the closure member in the closed position. A further advantage is that the valve mechanism is mounted externally on top of the waste holding tank rather that inside the tank as in some prior art mechanisms, which helps to avoid the problem of clogging of the valve mechanism by waste material. Also, the externally mounted valve mechanism of the invention can readily be removed for replacement or servicing in the field. A still further advantage of the flap-form valve member of the invention is that the member tends to at least minimize blow back of air from inside the holding tank or splash back of liquid when flushing the toilet.

Referring to the holding tank itself, the provision of a depression in its top wall improves the compressive strength of the holding tank as discussed above. Also, the valve mechanism is protected by the upwardly extending portions of the top wall on opposite sides of the depression in which the valve mechanism is located.

The pump used in the toilet of the invention delivers a single metered "shot" of flushing liquid at each operation. Further, the pump can easily be replaced in the field and requires no internal "plumbing" between the pump and the flushing liquid reservoir.

It should finally be noted that the preceding description relates to specific embodiments and that many modifications are possible within the broad scope of the invention. For example, it is not essential that the specific form of piston pump described be used for delivering flushing liquid into the toilet bowl. In another embodiment, for example, a bellows types pump could be used. Also, referring to the valve means, it appears to be preferable for the valve closure member to be spring biased to the closed position. In the illustrated embodiment, this is achieved by providing an integral plastic spring below the valve closure member. It will of course be appreciated that a similar effect may be achieved in other ways, for example, by spring biasing the roller of the valve operating mechanism. Also, it is to be noted that the particular valve operating means described could be replaced, for example, by a simple slide arrangement.

Referring to the holding tank, it is to be understood that the depression in the top ware of the tank may be of any appropriate shape. The depression may extend to one end of the holding tank as, for example, in the embodiment of FIG. 5, or could even extend from end to end of the holding tank, in which case the depression would be generally of the form of an inverted channel.

What we claim is:

1. A portable toilet comprising:

a bowl unit which defines a toilet bowl having a discharge opening, and a reservoir for a flushing liquid, said reservoir having a normally closed filler opening;

a holding tank normally disposed below and supporting said bowl unit, the holding tank having a top wall and defining a waste holding chamber having an inlet opening in said top wall for communication with the discharge opening of the toilet bowl, and a normally closed outlet opening, said top wall of the tank being contoured to define a depression in which said holding chamber inlet is disposed, and two generally flat bowl unit support surfaces located on respectively opposite sides of said depression and extending generally longitudinally of said holding tank, and on which said bowl unit is supported;

means normally coupling said bowl unit and holding tank together in co-operating relationship when the toilet is in use, said means allowing the unit and tank to be separated at appropriate times;

pump means communicating with said reservoir in the bowl unit and with said toilet bowl and operable in use to deliver flushing liquid from said reservoir into said bowl;

valve means for controlling discharge of material from said toilet bowl into said holding chamber, said valve means being disposed in said depression in the top wall of the holding tank, said depression being dimensioned to provide at least partial protection for said valve means against damage when the holding tank is separated from the bowl unit, and said valve means including: a flap-form closure member which is pivotable about an axis generally normal to the axis of said discharge opening of the toilet bowl between a closed position in which said member prevents communication between said discharge opening and said waste holding chamber, and an open position in which said closure member has pivoted downwardly clear of said opening to allow discharge of material from said toilet bowl into said chamber; and valve operating means located in a first plane generally parallel to a second plane containing said closure member when in its closed position and normally disposed below and supporting the member in said position, said valve operating means being retractable in said first plane to allow the closure member to pivot downwardly about its said axis and allow communication between said discharge opening of the bowl and the inlet of the waste holding chamber.

2. A toilet as claimed in claim 1, wherein said valve means further comprises an elongate spring member, disposed below and coupled to said valve closure member, and wherein said valve operating means supports said closure member by way of said spring member whereby the closure member is held in its closed position under a spring biasing effect.

3. A toilet as claimed in claim 2, wherein said valve operating means comprises roller means arranged for movement longitudinally of said spring member between a first position in which said roller means co-operates with said spring member to maintain said valve closure member in its closed position, and a second position in which the valve closure member adopts said downwardly pivoted position, and wherein the valve operating means further includes an axially slidable rod coupled to said roller means for moving the same between said first and second positions, said rod having an outer end portion which projects to the exterior of the toilet and by which the rod can be mutually displaced to operate said valve means.

4. A toilet as claimed in claim 3, wherein said valve means further includes abutment means arranged to co-operate with said roller means as the roller means moves from said first position to said second position to positively displace the valve closure member from its closed position.

5. A toilet as claimed in claim 3, wherein said axially-slidable operating rod of the valve operating means passes to the exterior of the toilet between abutting surface portions of said top wall of the holding tank and a bottom wall of the bowl unit, and wherein said opposing surface portions are formed to define channels for guiding and supporting said rod during its axial movement.

6. A toilet as claimed in claim 1, wherein said valve means is in the form of a self-contained unit removably fitted to said top wall of the holding tank, said valve means including a housing removably fitted to said top wall so as to enclose said holding chamber inlet opening, said housing itself defining: an inlet opening arranged to co-operate in liquid-tight fashion with said discharge opening of the toilet bowl when the holding tank and bowl unit are coupled together in said co-operating relationship; and an internal valve seat surrounding said housing opening; said valve closure member being pivotally mounted in said valve housing so as to engage said valve seat and close said housing opening when the member is in its closed position.

7. A toilet as claimed in claim 6, wherein said valve seat is fitted with a resilient sealing member of annular form against which the closure member seals, and wherein the closure member is mounted in free-floating fashion inside said valve housing so that the member can move within limits to accommodate irregularities in the surface of said valve seat.

8. A toilet as claimed in claim 1, wherein said top wall of the housing tank defines, between said support surfaces and adjacent an end of said depression, an upwardly projecting support formation having a flat upper surface, and wherein said bowl unit has a lower surface formed to define a depression which is generally complementary to said formation whereby said formation and depression co-operate to assist in locating the holding tank and bowl unit with respect to one another and to support the weight of a person seated on the toilet.

9. A toilet as claimed in claim 1, further comprising a seat section which includes a base shaped to fit over said bowl unit and having an upper surface which includes an opening communicating with said toilet bowl; a seat pivotally coupled to said base for movement between a raised position in which the toilet bowl is exposed and a lowered position of normal use; and a lid which is also pivotally coupled to the base for movement between a raised position and a lowered position in which it encloses said seat and said opening of the base, and wherein said coupling means are arranged to both couple said bowl unit and holding tank and retain said seat section on said bowl unit.

10. A toilet as claimed in claim 9, wherein said base of the seat section includes a skirt having a lower edge, and wherein said holding tank defines a protruding ledge means on which said lower edge of the skirt rests, and wherein said coupling means comprise releasable over-centre clips fitted to said holding tank and arranged, when in their operative positions, to clamp said base of the seat section to said holding tank and thereby trap the bowl unit between the seat section and the holding tank whereby the bowl unit and holding tank are coupled together in said co-operating relationship.

11. A toilet as claimed in claim 1, wherein said bowl unit further comprises a seat pivotally coupled to said unit for movement between a raised position in which the toilet bowl is exposed and a lowered position of normal use, and a lid which is also pivotally coupled to said bowl unit and is movable between a raised position and a lowered position to which it encloses said seat and toilet bowl.

12. A toilet as claimed in claim 1, wherein said pump means is a piston pump and comprises a cylinder having an inlet at its lower end and fitted in said bowl unit so that said inlet communicates with said reservoir, and a piston which is slidable axially of said cylinder and which is coupled to a piston rod having an outer end which projects upwardly from said cylinder for operating the pump, said cylinder having an outlet adjacent its upper end which communicates with said toilet bowl, and wherein the pump further includes one-way valve means arranged to allow flushing liquid to be drawn into the cylinder in response to upward movement of the piston but to close said opening during downward movement of the piston, and wherein the piston includes by-pass means arranged to allow liquid to flow past the piston when the piston rod is moving downwardly and arranged to prevent movement of the flushing liquid past the piston when the piston rod is moving upwardly.

13. A toilet as claimed in claim 12, wherein said one-way valve means comprises a non-floating ball member adapted to normally fit into and close said opening in the cylinder but arranged to be displaced by liquid flowing into the cylinder through said opening in response to upward movement of the piston.

14. A toilet as claimed in claim 12, wherein said pump cylinder outlet is defined by a nozzle arranged to deliver flushing liquid generally tangentially into said toilet bowl for flow in a spiral path to said discharge opening of the bowl.

15. A toilet as claimed in claim 1, wherein each of said holding tank and said bowl unit is a hollow plastic moulding, said reservoir of the bowl unit being of annular form and being defined between an inner wall of the moulding defining said bowl, and an outer wall of the moulding defining the exterior of the bowl unit.

16. A portable toilet comprising:

a bowl unit which defines a toilet bowl having a discharge opening, and a reservoir for a flushing liquid, said reservoir having a normally closed filler opening;

a holding tank normally disposed below and supporting said bowl unit, the holding tank having a top wall and defining a waste holding chamber having an inlet opening in said top wall for communication with the discharge opening of the toilet bowl, and a normally closed outlet opening, said top wall of the tank being contoured to define a depression in which said holding chamber inlet opening is disposed and, on opposite sides of said depression, surfaces for supporting said bowl unit;

means normally coupling said bowl unit and holding tank together in co-operating relationship when the toilet is in use, said means allowing the unit and tank to be separated at appropriate times;

pump means communicating with said reservoir in the bowl unit and with said toilet bowl and operable in use to deliver flushing liquid from said reservoir into said bowl;

valve means for controlling discharge of material from said toilet bowl into said holding chamber, said valve means being disposed in said depression in the top wall of the holding tank, and including: a flap-form closure member which is pivotable about an axis generally normal to the axis of said discharge opening of the toilet bowl between a position in which said member prevents communication between said discharge opening and said waste holding chamber, and a position in which said closure member has pivoted downwardly clear of said opening to allow discharge of material from said toilet bowl into said chamber; and valve operating means normally disposed below and supporting said closure member in its closed position, said valve operating means comprising: roller means arranged for movement longitudinally of said closure member between a first position in which said roller means maintains said member in its closed position, and a second position in which the valve closure member adopts said downwardly pivoted position; and an axially slidable rod coupled to said roller means for moving the same between said first and second positions, said rod having an outer end portion which projects to the exterior of the toilet and by which the rod can be manually displaced to operate said valve means;

and wherein said valve means further includes abutment means arranged to co-operate with said roller means as the roller means moves from said first position to said second position to positively displace the valve closure member from its closed position.

* * * * *